US007268313B1

(12) United States Patent
Aldridge

(10) Patent No.: US 7,268,313 B1
(45) Date of Patent: Sep. 11, 2007

(54) GARMENT PROCESSING SYSTEM AND METHOD THEREOF

(76) Inventor: Jeffrey L. Aldridge, 106 W. Concord Dr., Lebanon, OH (US) 45036

( * ) Notice: Subject to any disclaimer, the term of this patent is extended or adjusted under 35 U.S.C. 154(b) by 0 days.

(21) Appl. No.: 10/974,399

(22) Filed: Oct. 27, 2004

(51) Int. Cl.
*B07C 5/00* (2006.01)

(52) U.S. Cl. ..... 209/583; 209/937

(58) Field of Classification Search ..... 209/3.3, 209/583, 937; 700/221, 223, 224
See application file for complete search history.

(56) References Cited

U.S. PATENT DOCUMENTS 4,239,435 A * 12/1980 Weiss et al. ..... 198/349.8
5,687,850 A * 11/1997 Speckhart et al. ..... 209/2
6,050,421 A * 4/2000 Hansen ..... 209/44.1
6,695,145 B2 * 2/2004 Veau ..... 209/3.3
2003/0019798 A1 * 1/2003 Capps et al. ..... 209/630
2005/0096956 A1 * 5/2005 Young et al. ..... 705/8

* cited by examiner

*Primary Examiner*—Joseph C. Rodriguez

(57) ABSTRACT

A method for processing garments. Soiled garments corresponding to a route are received and washed. The garments are configured for processing and stored based on the route. From storage, the garments may be transferred to a sorter and sorted based on a determined sequence within the route, transferred to a repair station, transferred to a steaming station or transferred to a delivery vehicle for delivery. After sorting, repairing or steaming, the garments may be conveyed back to storage or loaded onto a delivery vehicle for delivery. Also, from storage, garments may be added or removed from the route and the garments may be sorted or re-sorted based on the new number of garments in the route.

11 Claims, 2 Drawing Sheets

GARMENT PROCESSING SYSTEM AND METHOD THEREOF

BACKGROUND

Commercial and industrial laundering facilities have become increasingly sophisticated in order to meet customer demand efficiently and economically. These facilities are generally large-scale operations and are capable of laundering and organizing thousands of garments per day.

BRIEF SUMMARY OF THE INVENTION

One example of the invention is a method of processing garments. Deliveries of soiled garments are received, where each delivery corresponds to a route and each garment is associated with a route. The garments are washed. The washed garments are configured for processing and each configured garment is associated with an identifier. The configured garments are placed onto a garment conveyor and transported along the garment conveyor. The identifiers are read to determine the route associated with each garment. The configured garments are transported to storage where they are stored based on route. A route sequence for a targeted route is determined for the stored configured garments and the stored configured garments are sorted in accordance with the determined route sequence. The sequenced configured garments are loaded onto a delivery vehicle for delivery, where each vehicle corresponds to a route. The sequenced configured garments are delivered.

Another example of the invention is a method of processing garments. Deliveries of soiled garments are received, where each delivery corresponds to a route and each garment is associated with a route. The garments are washed. The washed garments are configured for processing and each garment is associated with an identifier. The configured garments are placed onto a garment conveyor and transported along the garment conveyor. The identifiers are read to determine the route associated with each garment. The configured garments are transported to storage where they are stored based on route for at least 8 working hours without the use of a pre-sort buffer. A route sequence for a targeted route is determined for the stored configured garments and the stored configured garments are sorted in accordance with the determined route sequence. The sequenced configured garments are loaded onto a delivery vehicle for delivery, where each vehicle corresponds to a route. The sequenced configured garments are delivered.

Yet another example of the invention is a method of processing garments. Deliveries of soiled garments are received, where each delivery corresponds to a route and each garment is associated with a route. The garments are washed. The washed garments are configured for processing and each configured garment is associated with an identifier. The configured garments are placed onto a garment conveyor and transported along the garment conveyor. The identifiers are read to determine the route associated with each garment. The configured garments are transported to storage where they are stored based on route without the use of a pre-sort buffer. A route sequence for a targeted route is determined for the stored configured garments and the stored configured garments are sorted in accordance with the determined route sequence. The sequenced configured garments are loaded onto a delivery vehicle for delivery less than 36 clock hours from the sorting of the configured garments, where each vehicle corresponds to a route. The sequenced configured garments are delivered.

The foregoing brief description of examples of the invention should not be used to limit the scope of the present invention. Other examples, features, aspects, embodiments and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings should be regarded as illustrative in nature and not restrictive.

BRIEF DESCRIPTION OF DRAWINGS

While the specification concludes with claims which particularly point out and distinctly claim the invention, it is believed the present invention will be better understood from the following accompanying drawings, in which like reference numerals identify the same elements and which:

DETAILED DESCRIPTION

Figure 1:
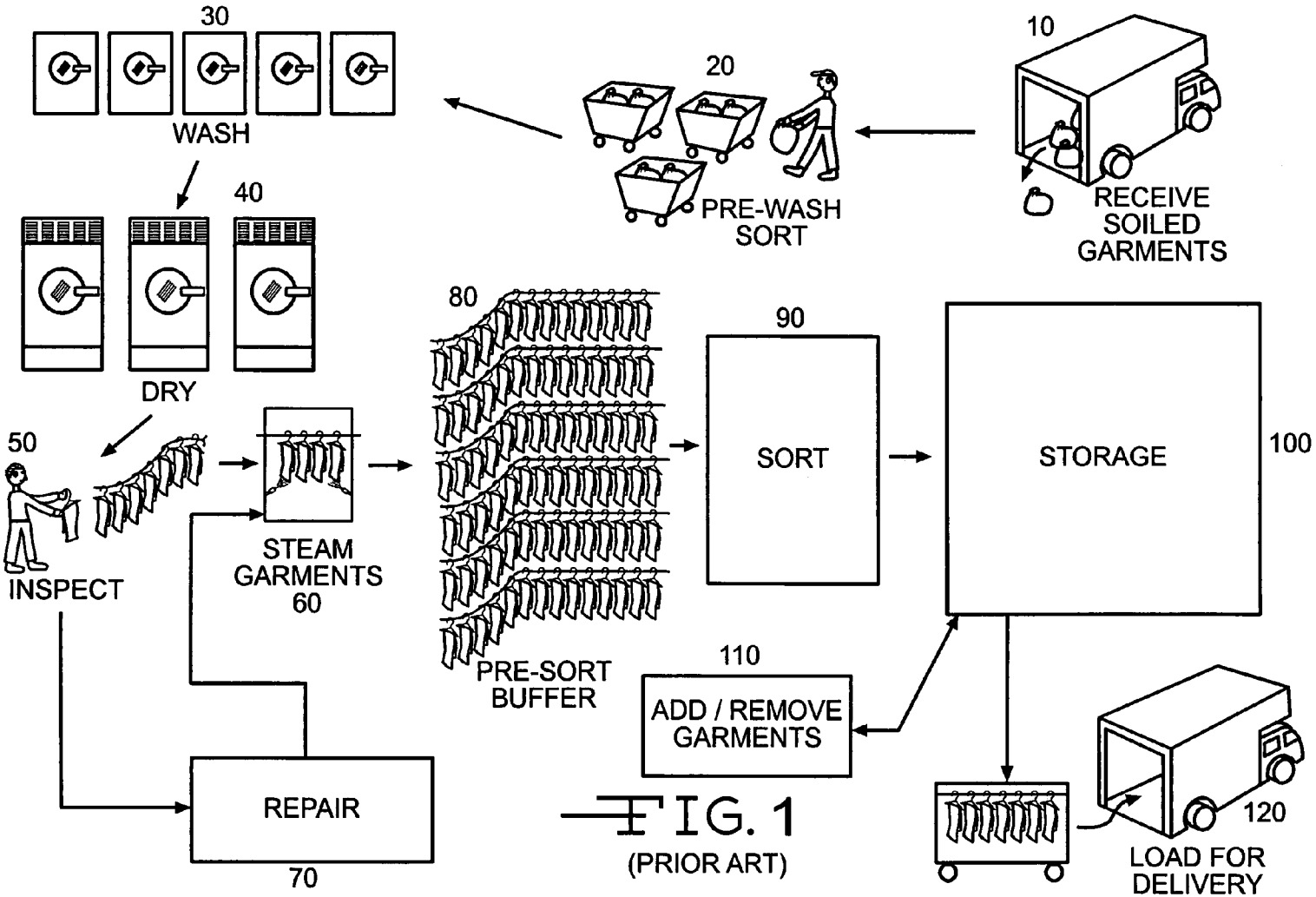
FIG. 1 (PRIOR ART)
FIG. 1 is a schematic representation of an example of a process for laundering, drying and sorting garments.

Referring now to the figures, FIG. 1 shows a schematic of an exemplary embodiment of a process for laundering, drying, and sorting garments. Soiled garments are delivered to the laundering facility by delivery vehicles 10, typically delivery trucks. Each delivery of soiled garments corresponds to a specific route. The soiled garments are unloaded from the vehicle and undergo a pre-wash sort 20 where the garments may be separated by the type of garment (e.g. garage wear, lab wear, etc.), by color (e.g. light, dark, etc.) and the like. Each garment may include a permanent or temporary unique identifier, such as an alphanumeric code, which may be unique to each garment or a class of garments. The identifier may be manually readable by workers or may be encoded in a machine readable format, such as a bar code, radio frequency (RF) chip, and the like. While the following embodiment is described in the context of machine readable identifiers, it is understood that it may be easily modified to accommodate manually readable identifiers.

After the pre-wash sort 20, the garments are transferred to washing machines 30, where they are washed. For the purposes of this description, "wash", "washing" and "washed" may mean traditional laundering, dry cleaning, and the like and "washing machine" may refer to an apparatus for washing. After washing 30, the garments are transferred to the dryers 40 where they are dried. Alternatively, the garments may be dried as they pass through a steam tunnel 60. Once dried, the garments are transferred to an inspection station 50. At the inspection station 50, a worker inspects the garments for damage such as rips, tears, missing buttons and such. After inspection, each garment is configured for processing and placed on a conveyor. Garments may be configured for processing by being hung on hangers, folded or the like. The garments may be delivered as configured for processing or may be subsequently configured for delivery by being hung on hangers, folded or the like. In one embodiment, a garment is configured for processing by being hung from a clothes hanger where the hanger is attached to a carrier that interfaces with the conveyor. The carrier may have an identifier thereon. The identifier may be manually readable by workers or may be encoded in a machine readable format, such as a bar code, radio frequency (RF) chip, and the like. While the embodiment is described in the context of machine readable identifiers, it is understood that it may be easily modified to accommodate manually readable identifiers. A worker may then scan the garment's machine readable identifier. Once placed on the conveyor, the garment's machine readable identifier and carrier's machine readable identifier may be automatically associated in the sorter's computer. Once on the conveyor, each garment is conveyed to the repair station 70, a steaming station 60, or pressing station (not shown). Alternatively, the garments may be steamed or pressed any time after washing, or not at all, and do not necessarily have to be steamed or pressed prior to sorting. While the garments are being conveyed, the carrier may be read at various points along the conveyor. Alternatively, it may be unnecessary to use carriers. Instead, a machine readable identifier in the garment may be read during conveying.

The garments not needing repair are steamed 60 to reduce wrinkles and conveyed to and collected in a pre-sort buffer 80. For the purposes of this description, a "buffer" is a temporary accumulation of garments as part of serialized operations. For example, a buffer may hold garments pending a predetermined subsequent operation. In such case, a buffer is coupled to a designated operation. Typically, a buffer would hold garments on the order of magnitude of hours. For instance, a buffer may hold garments for less than eight working hours where "working hours" means the hours of operation of a laundering facility and does not include breaks such as overnight, when the facility is closed, or machine downtime for such things as repair, maintenance and the like. Furthermore, "pre-sort buffer" will refer to a type of buffer where garments are presorted based on route and temporarily accumulated as an immediate preceding step to a sorting operation.

The pre-sort buffer 80 consists of several rails, where each route is temporarily assigned to one or more rails. Based on reading the machine readable identifiers, each garment is conveyed to a pre-sort buffer rail corresponding to its route. Once all, or a substantial majority, of the garments for a route are collected on a rail, the garments may be directly conveyed to a sorter 90 where they are sorted by delivery sequence within the route. For instance, the sequence may be the order of deliveries to customers, by employees within a customer, by type of clothing, or any other order deemed desirable. Sorting may be performed manually by one or more workers or by sorting machines. Once sorted, the garments are automatically and immediately conveyed to storage 100 where they are stored until they are scheduled to be loaded for delivery 120. For the purposes of this description, "storage" will refer to longer term holding, often, but not necessarily, encompassing a magnitude of days. Storage is often where garments are kept prior to loading on a truck, but may also include a temporary holding area for garments to be removed from the route prior to their delivery to a stockroom (not shown). Storage may also have no predetermined subsequent process step. For instance, one or more garments in storage could be routed to a variety of different locations or processes (e.g., repair, loading, removal, sorting, resorting, etc.).

The garments conveyed to the repair station 70 are repaired. Once a garment is repaired, it may be placed onto the conveyor and conveyed to the steaming station 60, to the pre-sort buffer 80 and sorted 90 and stored 100 with other garments of the route. However, if the route has already been sorted, the repaired garment may be placed onto the conveyor, conveyed to the steaming station 60, to the pre-sort buffer 80, sorted 90, and a worker will then have to manually place the garment in its proper place within storage 100 (e.g. with the garments for the same customer, with the garments for the same employee of the customer, etc.).

Also, from time to time, it may be necessary to add new garments to the route (e.g. for a new employee of a customer, etc.), add stragglers, or remove garments from the route (e.g. for an employee who no longer works with a customer, etc.) 110. For the purposes of this disclosure, "stragglers" will refer one or more garments associated with a route that are separated from the remainder of the route. For example, a straggler may be a garment that is inadvertently left on or near the delivery vehicle, dropped on its way to a washing machine or a drying machine, delayed in another process, separated from its hanger, separated from the conveyor, etc. For a new garment or straggler, the garment may be placed onto the conveyor and conveyed to the steaming station 60, to the pre-sort buffer 80 and sorted 90 and stored 100 with other garments of the route. However, if the route has already been sorted, a worker will have to manually place the garment in its proper place within the route within storage 100.

Figure 2:
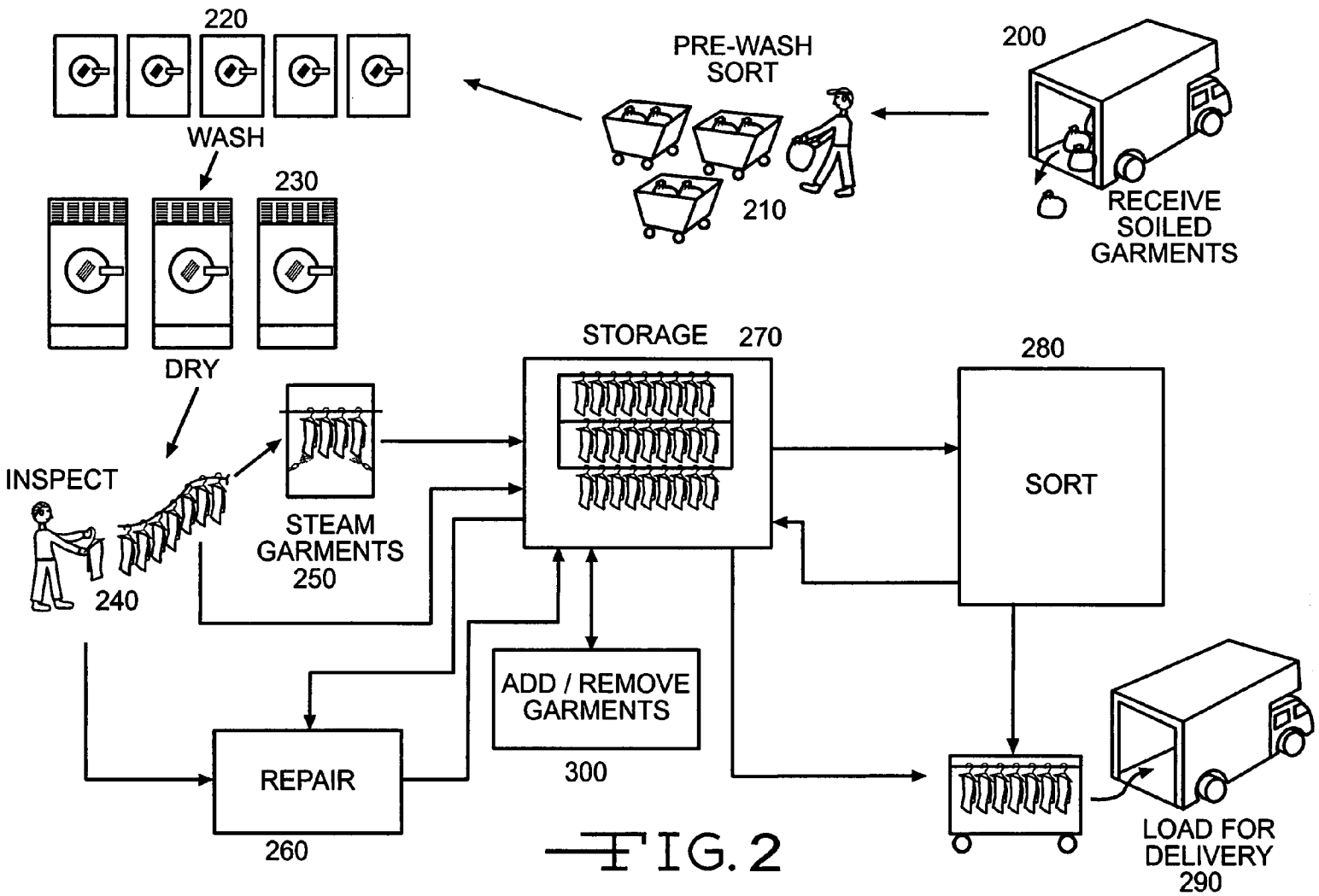
FIG. 2 is a schematic representation of an example of a process for laundering, drying and sorting garments.

Referring now to FIG. 2 showing another embodiment of a process for laundering, drying and sorting garments. Soiled garments are delivered to the laundering facility by delivery vehicles 200, typically delivery trucks. Each delivery of soiled garments corresponds to a specific route. The soiled garments are unloaded from the vehicle and undergo a pre-wash sort 210 where the garments may be separated by the type of garment (e.g. garage wear, lab wear, etc.), by color (e.g. light, dark, etc.) and the like. Each garment may include a permanent or temporary unique identifier, such as an alphanumeric code, which may be unique to each garment or a class of garments. The identifier may be manually readable by workers or may be encoded in a machine readable format, such as a bar code, radio frequency (RF) chip, and the like. While the following embodiment is described in the context of machine readable identifiers, it is understood that it may be easily modified to accommodate manually readable identifiers.

After the pre-wash sort 210, the garments are transferred to washing machines 220, where they are washed. After washing 220, the garments are transferred to the dryers 230 where they are dried. Alternatively, the garments may be dried as they pass through a steam tunnel 250. Once dried, the garments are transferred to an inspection station 240. At the inspection station 240, a worker inspects the garments for damage such as rips, tears, missing buttons and such. After inspection, each garment is configured for processing and placed on a conveyor. In one embodiment, a garment is hung from a clothes hanger where the hanger is attached to a carrier that interfaces with the conveyor. The carrier may have an identifier thereon. The identifier may be manually readable by workers or may be encoded in a machine readable format, such as a bar code, radio frequency (RF) chip, and the like. While the embodiment is described in the context of machine readable identifiers, it is understood that it may be easily modified to accommodate manually readable identifiers. A worker will then scan the garment's machine readable identifier. Once placed on the conveyor, the garment's machine readable identifier and carrier's machine readable identifier may be automatically associated in the sorter's computer. While the garments are being conveyed, the carrier may be read at various points along the conveyor. Alternatively, it may be unnecessary to use carriers. Instead, a machine readable identifier in the garment may be read during conveying.

Once on the conveyor, each garment is conveyed to the repair station 260, to a steaming station 250 (or pressing station (not shown)), or to storage 270. The garments may be steamed 250 to reduce wrinkles prior to being conveyed to storage 270, or the garments may be conveyed directly to storage 270 and steamed 250 at a later time. The garments are grouped together in storage 270 based on route, but out of sequence. Based on reading the machine readable identifiers, each garment is conveyed to a storage rail corresponding to its route. The garments may remain in storage 270 until it is determined that they may be sorted. This determination may be based on proximity to delivery date, the sorter being idle and the like. In one embodiment, the garments may be stored for at least 8 working hours prior to sorting. In another embodiment, the garments may be sorted less than 36 clock hours from when they are scheduled to be loaded for delivery; where "clock hour" means one of the 24 equal parts of a day. From storage 270, the garments may be conveyed to a sorter 280 where they are sorted by delivery sequence within the route. For instance, the sequence may be the order of deliveries to customers, by employees within a customer, by type of clothing, or any other order deemed desirable. Sorting may be performed manually by one or more workers or by sorting machines. Once sorted, the garments may be conveyed to a staging area (not shown) prior to loading for delivery 290, loaded for delivery 290 or conveyed back into storage 270 and loaded for delivery 290 at a later time.

Also, garments may be conveyed to the repair station 260 from the inspection station 240, from storage 270 or from the steaming station 250. The garments conveyed to the repair station 260 are repaired. Once a garment is repaired, it may be placed onto the conveyor, conveyed to the steaming station 250 or conveyed to storage 270 and stored with other garments from the same route. If the route has previously been sorted, the garment may be conveyed to the end of the rail for the route and the route may be re-sorted by the sorter 280 to include the repaired garment in its proper position within the route. Once re-sorted, the garments may be conveyed to a staging area (not shown) prior to loading for delivery 290, loaded for delivery 290 or conveyed back into storage 270 and loaded for delivery 290 at a later time. Also, from time to time, it may be necessary to add new garments to the route (e.g. for a new employee of a customer, etc.), add stragglers, or remove garments from the route (e.g. for an employee who no longer works with a customer, etc.). For a new garment or straggler, the garment may be placed onto the conveyor, conveyed to the steaming station 250, conveyed to storage 270 and stored with other garments from the same route. If the route has previously been sorted 280, the garment may be conveyed to the end of the rail for the route and the route may be re-sorted by the sorter 280 to include the new garment, or straggler, in its proper position within the route. Once re-sorted, the garments may be loaded for delivery 290 or may be conveyed back into storage 270 and loaded for delivery at a later time. For garments that are to be removed from the route, they may be conveyed from storage 270 to the stockroom (not shown).

Having shown and described various embodiments, further adaptations of the methods and systems described herein can be accomplished by appropriate modifications by one of ordinary skill in the art without departing from the scope of the present invention. Several of such potential modifications have been mentioned, and others will be apparent to those skilled in the art. For example, the methods and systems described herein may be applied to any garment processing facility that may be used as part of a uniform rental program. Furthermore, while the methods and systems are described in the context of garments and garment processing, the principles may be applied to any large scale processing facility. Accordingly, the scope of the present invention should be considered in terms of the following claims and is understood not to be limited to the details of structure and operation shown and described in the specification and drawings.

The invention claimed is:

1. A method for processing garments, comprising:

(a.) receiving one or more deliveries of soiled garments, each delivery corresponding to a route, each garment being associated with a route;

(b.) washing the received garments;

(c.) configuring the washed garments for processing, each configured garment being associated with an identifier;

(d.) placing the configured garments on a garment conveyor;

(e.) transporting the configured garments along the garment conveyor;

(f.) reading the identifiers to determine the route associated with each garment;

(g.) transporting the configured garments to storage where the configured garments are stored based on route wherein storage comprises an accumulator operatively configured such that selected garments in storage are subject to being automatically routed bi-directionally between storage and a plurality of processing locations;

(h.) determining the route sequence of stored configured garments within a target route;

(i.) sorting the stored configured garments for the target route in accordance with the determined route sequence to form-sequenced configured garments;

(j.) loading the sequenced configured garments onto a delivery vehicle for delivery, each vehicle corresponding to a route; and (k.) delivering the sequenced configured garments.

2. The method of claim 1 where the configured garments are transported to storage without the use of a pre-sort buffer comprising a plurality of sequential accumulators each selectively coupled to receive incoming configured garments for presorting based on route and temporarily accumulated as an immediate preceding step to a sorting operation.

3. The method of claim 1 further comprising the step of holding the stored configured garments in storage for at least 8 working hours.

4. The method of claim 1 wherein the sorting is performed less than 36 clock hours before loading for delivery.

5. The method of claim 1 wherein repaired garments are added to the stored configured garments.

6. The method of claim 1 wherein stragglers are added to the stored configured garments.

7. The method of claim 1 wherein new garments are added to the stored configured garments.

8. The method of claim 1 wherein altering the number of stored garments comprises removing one or more configured garments.

9. The method of claim 1 wherein the garments are configured for delivery prior to loading for delivery.

10. The method of claim 1 wherein a plurality of operations denoted (a) to (k) comprise a sequence of operations performed in an order (a.) to (k.) listed.

11. The method for processing garments of claim 1, wherein the plurality of processing locations comprises a group consisting of a repair location, steam tunnel, stock room, loading location, garment removal location, and garment sorter.

* * * * *